US005655803A

United States Patent [19]

Tacoronte

[11] Patent Number: 5,655,803

[45] Date of Patent: Aug. 12, 1997

[54] UNIVERSAL FIREARM BOW AND PACK HOIST-LINE

[76] Inventor: Hency Michael Tacoronte, 1840 Shillelagh Rd., Chesapeke, Va. 23323

[21] Appl. No.: 414,102

[22] Filed: Mar. 31, 1995

[51] Int. Cl.[6] ..... A45F 3/14; A66C 1/14

[52] U.S. Cl. ..... 294/1.1; 224/150; 224/184; 224/913; 224/916; 224/82.11; 224/149; 224/165

[58] Field of Search ..... 294/1.1, 74, 82.1, 294/82.11, 137, 141, 142, 146, 147, 149, 150, 153, 156, 165; 224/149, 150, 184, 250, 257, 258, 268, 269, 913, 916

[56] References Cited

U.S. PATENT DOCUMENTS

| | | | |
|---|---|---|---|
| 1,332,088 | 2/1920 | Wagner . | |
| 2,715,989 | 8/1955 | Sjodin et al. | 224/913 X |
| 2,915,233 | 12/1959 | Moomaw | 224/913 X |
| 3,035,746 | 5/1962 | Hayes | 224/913 X |
| 3,074,074 | 1/1963 | Lovering . | |
| 3,258,182 | 6/1966 | McDonald . | |
| 4,280,644 | 7/1981 | Shindelka . | |
| 4,478,311 | 10/1984 | Anderson . | |
| 4,760,944 | 8/1988 | Hughes | 224/913 X |
| 4,768,689 | 9/1988 | Davis | 224/913 X |
| 5,165,584 | 11/1992 | Meagher et al. | 224/913 X |
| 5,246,154 | 9/1993 | Adams et al. . | |
| 5,325,618 | 7/1994 | Turner . | |
| 5,335,835 | 8/1994 | Hogan | 224/257 |
| 5,388,877 | 2/1995 | Wenk | 294/1.1 |

*Primary Examiner*—Johnny D. Cherry
*Attorney, Agent, or Firm*—John F. Carroll IV

[57] ABSTRACT

Hoist-line for lifting rifles and shot guns to elevated positions has a snap hook for attachment to a rifle trigger guard and a fixed barrel engagement loop, each permanently attached to an elongated hoist line near its bottom end. The trigger guard snap hook and barrel engagement loop are advantageously sized and spaced apart to maintain an attached rifle in a vertical orientation when the device is hoisted from above, and accommodate rifles of varying barrel length and bore. Modification of the hoist-line has a bow engaging strap and string engaging strap for temporary attachment of an archery bow adjacent to an attached firearm.

16 Claims, 4 Drawing Sheets

UNIVERSAL FIREARM BOW AND PACK HOIST-LINE

FIELD OF INVENTION

The present invention relates to hoist-lines and hoist-line slings. More particularly, the present invention relates to hoist-lines adapted to receive, carry and safely hoist elongated firearms, such as rifles and shot guns, to elevated positions.

BACKGROUND

Frequently, when hunting, it is necessary for the hunter to climb to elevated positions, such as onto tree stands, crows nests or the like. When hunting with elongated firearms, such as rifles and shot guns, hunters have typically had the options either to carry their firearms up with them as they climb into position, or, alternatively, first climb up without the firearm, then, after assuming a safe position, use a hoisting device to pull the firearm up behind them.

Several prior devices are known which allow a hunter to climb while carrying an elongated firearm. Such prior devices typically comprise gun slings or similar apparatuses, by which the hunter carries the gun over a shoulder or across his back while climbing. Turner U.S. Pat. No. 5,325,618, Shindelka U.S. Pat. No. 4,280,644, Adams U.S. Pat. No. 5,246,154, Wagner U.S. Pat. No. 1,332,088 and McDonald U.S. Pat. No. 3,258,182 are examples of such prior devices. A problem with these prior devices is that, by the very nature of carrying an elongated firearm while attempting to climb, for example, up a dense tree, the firearm impedes the user's ability to safely climb. When climbing with an elongated firearm, the firearm can easily become snagged on tree limbs or other obstacles. In addition, carrying a firearm while climbing presents a significant hazard should the climber accidently fall with the firearm strapped to him.

A more desirable method of transporting a firearm to an elevated position, such as to a crows nest or to a tree platform, is to leave the gun safely on the ground, climb up to the elevated position, and then, using a hoisting device, pull the firearm up. This method has the obvious advantages of freeing the climber's hands, not allowing the firearm to become entangled (i.e. in the tree's branches) while climbing, and reducing the possibility of the hunter's falling with the gun. Several prior devices that permit a hunter to first climb to an elevated position and then hoist a firearm from the ground with his hands are known. For example, it is common practice for hunters to simply use a length of rope and tie a knot around the firearm in order to hoist the rifle. This method can result in the gun falling to the ground if the knot is not sufficiently snug. Other devices of this type, such as those disclosed in Anderson U.S. Pat. No. 4,478,311 and Lovering U.S. Pat. No. 3,074,074 are known. Another problem of this prior method is that the climber typically has to hold one end of the hoisting device (i.e. the rope or strap) in one of his hands while climbing. This not only makes it somewhat difficult to climb, but there also exists the inconvenience of having to climb back down to retrieve the rope, should the climber accidently drop the rope while climbing.

SUMMARY AND OBJECTS OF THE INVENTION

Accordingly, it is a primary object of the present invention to provide a hoisting device which is attachable to elongated firearms with which hunters, having first climbed to an elevated location above the ground, may safely hoist the firearm.

It is another object of the present invention to provide a device of the character described comprising an elongated strap provided with a clasping mechanism positioned intermediately along the strap and adapted to fasten to the trigger guard of the firearm, and a loop fastener attached to the strap and adapted to receive the barrel end of the firearm.

It is another object of the present invention to provide a device of the character described wherein the loop fastener is permanently attached to the strap and spaced apart from the trigger guard clasping mechanism a sufficient distance to engage the barrel of the firearm intermediately along its barrel, and thus provide a universal hoist-line device adapted to receive a wide range of sizes and shapes of elongated firearms.

It is another object of the present invention to provide a device of the character described having a clasping mechanism at the top end of the strap member for temporary fastening to the clothing, apparel or gear of a climber, thus rendering the climber's hands free of the hoisting device and the firearm while climbing.

It is another object of the present invention to provide a device of the character described wherein, once attached to the hoisting device, an elongated firearm may be held in an approximately parallel orientation relative to an intermediate section of the hoisting strap, thus reducing the opportunity for the firearm to become entangled with obstacles (such as tree limbs and the like) as the device and the firearm are pulled up.

It is another object of the present invention to provide a device of the character described having a clasping mechanism at the bottom end of the hoisting strap for temporary fastening the hoist-line to a pack, satchel or the like.

It is another object to provide a modification of the present invention having archery bow fastener members intermediately located along the hoist-line strap, by which an archery bow may be temporarily secured to the hoist-line strap.

It is another object to provide a modification of the present invention in which the archery bow fastener members are adapted to secure an archery bow to the hoist-line strap adjacent to an elongated firearm attached to the opposite face of the hoist-line strap.

Further objects and advantages of my invention will become apparent from a consideration of the drawings and ensuing description thereof.

DRAWINGS

DESCRIPTION OF THE PREFERRED EMBODIMENT

Figure 1:
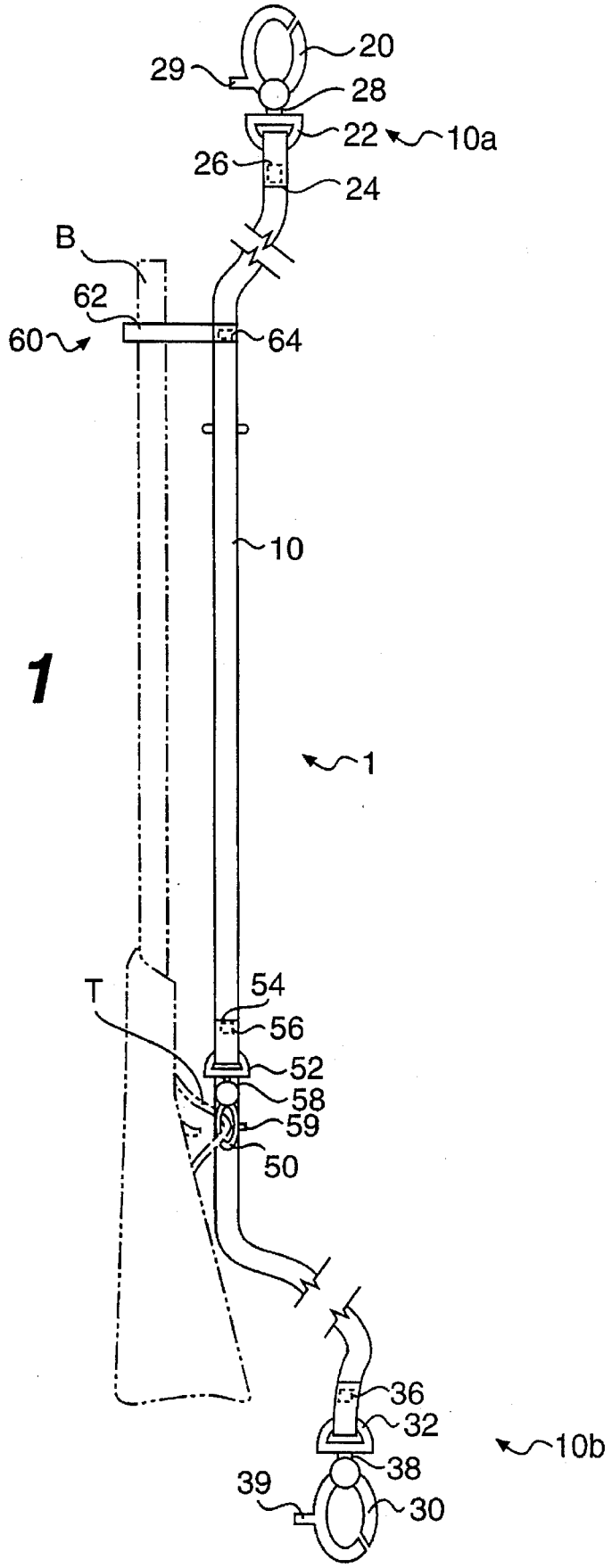
FIG. 1 is a perspective view of the device constructed in accordance with the invention showing the manner of attachment to a firearm.

The present invention is an elongated hoist line, generally designated 1 in the figures, which is adapted to safely hoist elongated firearms and other equipment to an elevated position. The hoist line 1 comprises a hoist-line strap 10 preferably constructed of a single narrow band of flexible and non-elastic material such as dacron, nylon, or cotton woven webbing or equivalent material. The hoist-line strap 10 may be constructed of dacron webbing, about 1-inch wide and about ⅛" thick, and should be of sufficient strength to support the weight of a gun, rifle or other firearm, as well as additional materials, including a pack or satchel containing ammunition and other goods which a hunter may typically carry with him to an elevated hunting position.

A snap hook 20 is secured to the upper end 10*a* of the hoist-line strap 10 by inserting the end of the webbing 24 into the base 22 of the snap hook 20, and turning the end of the webbing 24 back onto hoist-line strap 10 and sewing the end thereto as indicated at 26. In the preferred embodiment of the invention the snap hook 20 is spring-loaded such that it is biased in the closed position, and preferably comprises a swivel 28 and a protruding finger extension 29 to facilitate ease of opening the snap hook by a user who may be wearing gloves.

A snap hook 30 is secured to the lower end 10*b* of the hoist-line strap 10 by inserting the end of the webbing 34 into the base 32 of the snap hook 30, and turning the end of the webbing 34 back onto hoist-line strap 10 and sewing the end thereto as indicated at 36. In the preferred embodiment of the invention the snap hook 30 is spring-loaded such that it is biased in the closed position, and preferably comprises a swivel 38 and a protruding finger member 39 to facilitate ease of opening the snap hook by a user who may be wearing gloves.

In the preferred embodiment of the invention, the hoist-line strap 10 is approximately 25 to 30 feet long. Approximately 2 feet from the lower end 10*b* of the hoist-line strap, a trigger guard snap hook 50 is secured to the hoist-line strap 10. The it trigger guard snap hook 50 is attached to the hoist-line strap 10 by inserting a second length of webbing material 40 into the base 52 of the snap hook 50, and turning the two ends of the webbing 54 back onto hoist-line strap 10 and sewing the ends thereto as indicated at 56. In the preferred embodiment of the invention the snap hook 50 is spring-loaded such that it is biased in the closed position, and preferably comprises a swivel 58 and a protruding finger member 59 to facilitate ease of opening the snap hook by a user who may be wearing gloves. The trigger guard snap hook 50 is sized large enough to engage common rifle trigger guards, and, in the preferred embodiment of the invention has a maximum grasping dimension of ½ inch.

A barrel engaging loop, generally indicated as 60 in the drawings, is located intermediately along the hoist-line strap 10, approximately 18 inches above the trigger guard snap hook 50. The barrel engaging loop 60, preferably comprises a length of webbing material 62 which is sewn to the hoist-line strap 10. The barrel engaging loop 60 preferably is oriented perpendicular to the length of the hoist-line strap 10, as shown in the figures. Opposite ends of the webbing material 62 are turned back onto itself to form a closed loop, and the overlapping portion of the webbing material 62 is sewn to the hoist-line strap 10 as indicated at 64.

Figure 2:
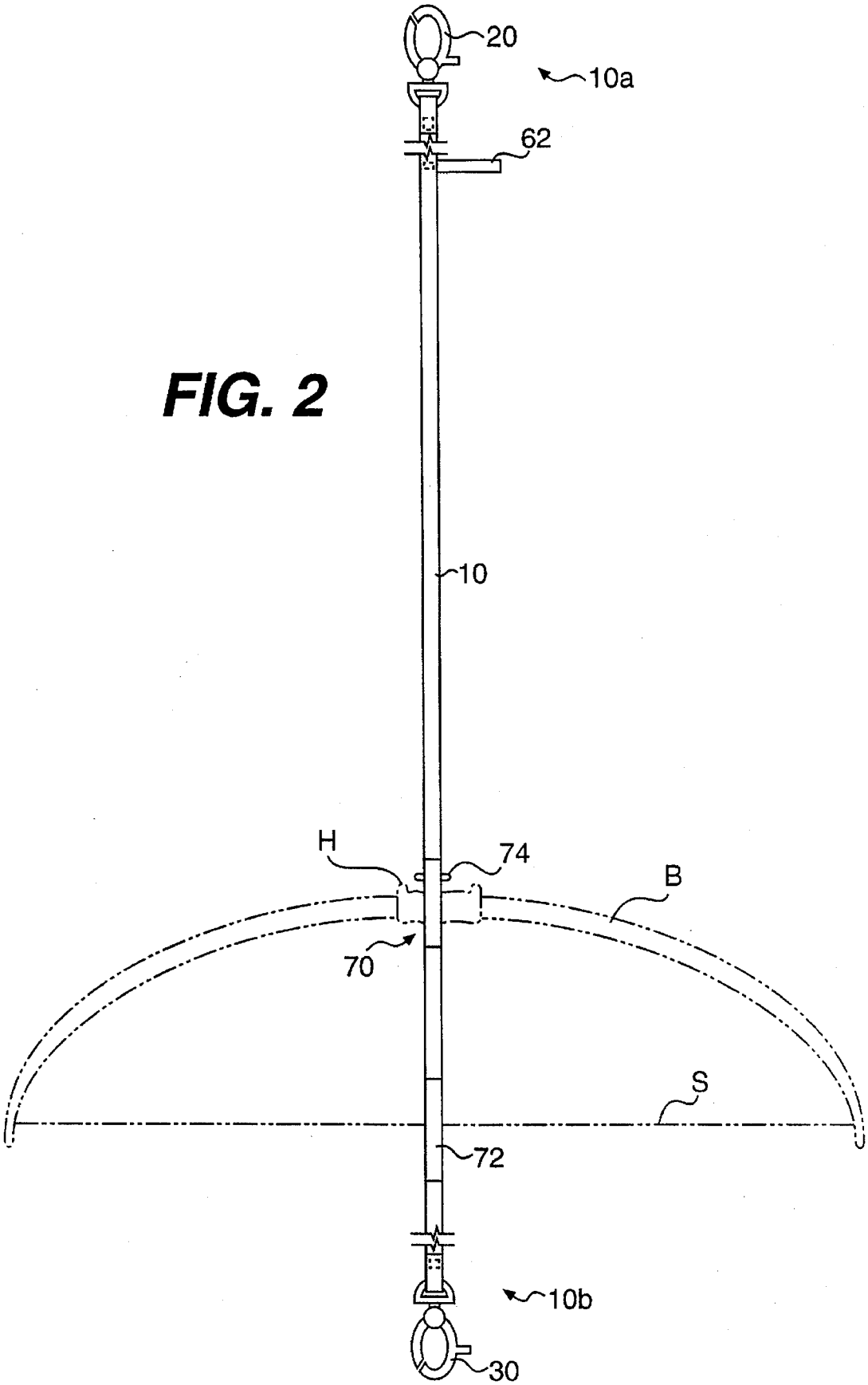
FIG. 2 is a perspective view of the device constructed in accordance with the invention showing the manner of attachment to an archery bow.
Figure 3:
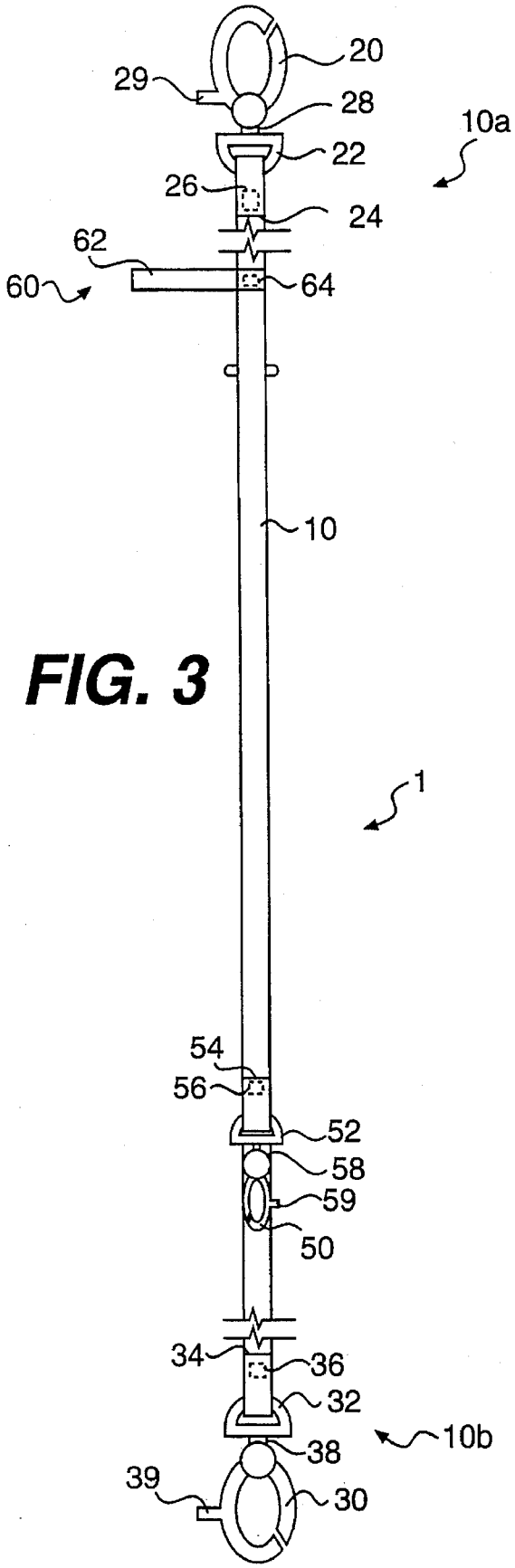
FIG. 3 is a plan view showing the front of the device.
Figure 4:
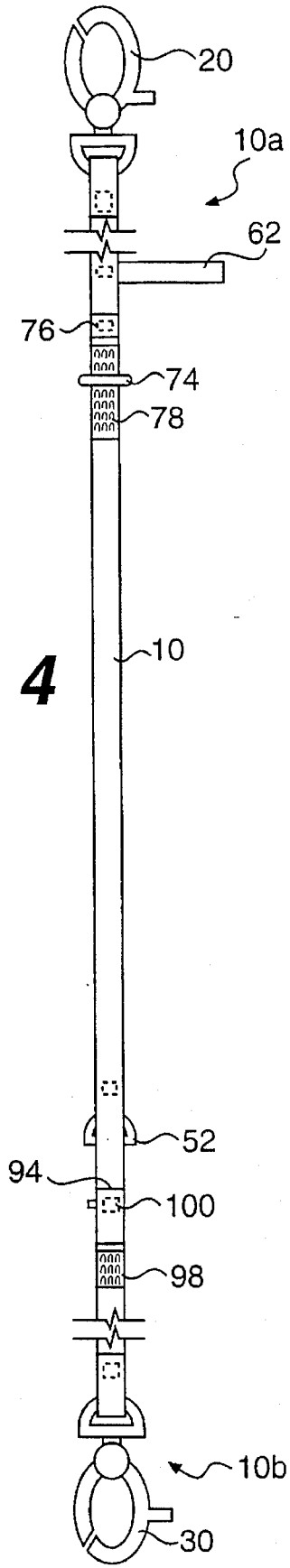
FIG. 4 is a plan view showing the back of the device.
Figure 5:
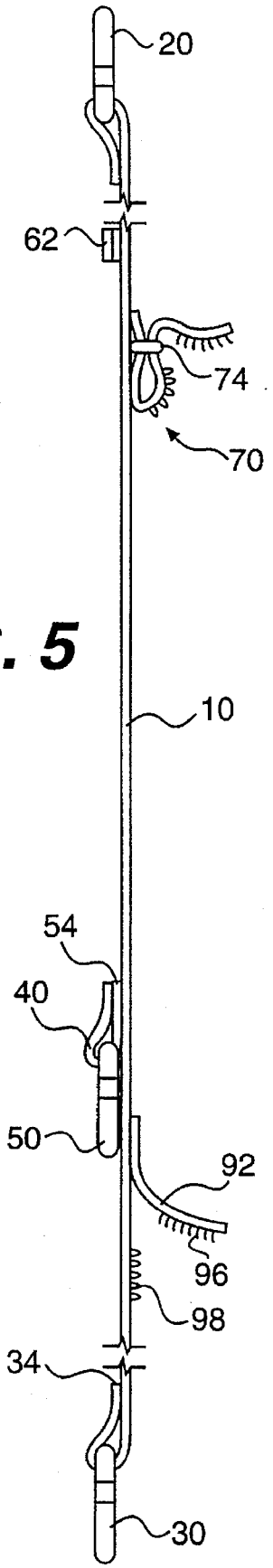
FIG. 5 is a plan view showing the side of the device.

A modification of the invention which is adapted to carry an archery bow is shown in FIGS. 2 and 4. A bow handle engaging strap (generally indicated 70 in the figures) and a bow string engaging strap (generally indicated 90 in the figures) are attached to the hoist-line strap 10 on the opposite face of the hoist-line strap 10 to which the trigger guard snap hook 50 is attached.

Figure 6:
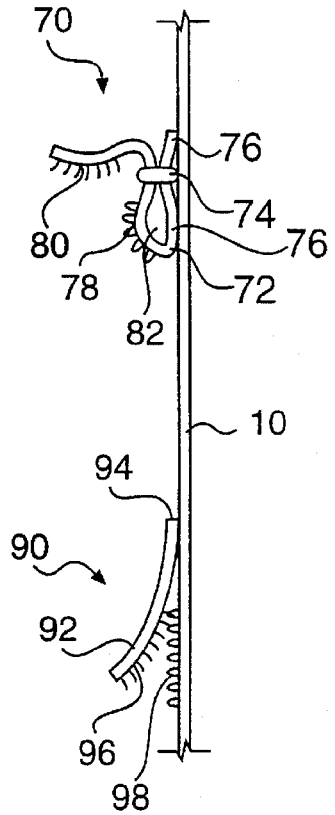
FIG. 6 is a partial plan view showing the details of construction of a modification of the present invention with the archery bow engaging strap in a closed position.

The bow handle engaging strap 70 preferably comprises a 15-inch length of webbing material 72 longitudinally aligned with the hoist-line strap 10, and attached at one of its ends to the hoist-line strap 10 intermediately between the points of attachment of the barrel engaging loop 60 and the trigger guard snap hook 50 to the hoist-line strap 10. The webbing material 72 is sewn to the hoist-line strap 10 on opposite sides of a strap lock 74, as indicated at 76. The strap lock 74 is a metallic loop, through which the loose end of the webbing material 72 may be inserted, as shown in FIG. 6. Mating lengths of hook-and-loop fastener material 78 and 80, respectively, are attached to the outboard side of the webbing material 72. The free end of the webbing material 72 may be pulled through the strap lock 74 until the mating lengths of hook-and-loop fastener material 78 and 80, respectively, are positioned on opposite sides of the strap lock 74, such that a closed loop 82 may be effected when the mating lengths of hook-and-loop fastener material 78 and 80 are fastened against each other.

The bow string engaging strap 90 preferably comprises a 10-inch length of webbing material 92 longitudinally aligned with the hoist-line strap 10, and attached at its upper end 94 to the hoist-line strap 10 approximately 20 inches from the lower end 10*b* of the hoist-line strap 10. Mating lengths of hook-and-loop fastener materials 96 and 98, respectively, are attached to opposing faces of the webbing material 92 and the hoist-line strap 10. The upper ends of the hook-and-loop fastener materials 96 and 98, respectively, are preferably approximately 4-inches beneath the point of attachment 100 of the webbing material 92 to the hoist-line strap 10, thus effecting a closed loop between the webbing material 92 and the hoist-line strap 10 when the hook-and-loop fastener materials 96 and 98 are mutually engaged.

OPERATION

A method of using the present invention to hoist an elongated firearm (such as a rifle or a shot gun) to an elevated position (such as a tree stand) follows. The hoist line is temporarily connected to the firearm by first sliding the barrel B of the firearm into the barrel engaging loop 60. After the barrel B of the firearm is inserted into the barrel engaging loop 60, the trigger guard snap hook 50 is used to engage the trigger guard T of the firearm. It will be understood from the above description that the firearm is now secured to the hoist line and oriented approximately parallel to the intermediate section of the hoist-line strap 10 between the trigger guard snap hook 50 and the barrel engaging loop 60.

In the preferred embodiment of the invention, the size of the barrel engaging loop 60 is sufficiently large to encircle the barrel of most common rifles and shot guns. Also, in the preferred embodiment of the invention, the trigger guard snap hook 50 and the barrel engaging loop 60 are attached to the hoist-line strap 10 in close enough proximity to each other that the barrel engaging loop 60 is several inches (i.e. between 3 and 10 inches) from the muzzle end of the barrel B when the trigger guard snap hook 50 is engaged with the firearm's trigger guard T. It will thus be understood that a single device constructed in accordance with the preferred embodiment of the present invention may be secured to elongated firearms of somewhat varying barrel lengths and of varying muzzle bores.

Figure 7:
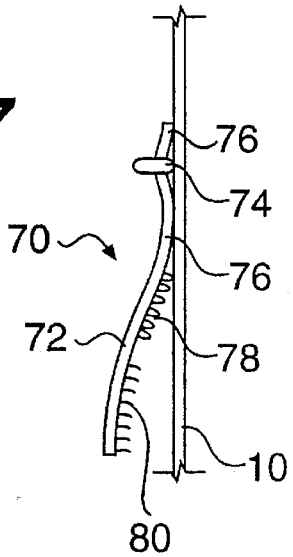
FIG. 7 is a partial plan view showing the details of construction of a modification of the present invention with the archery bow engaging strap in a open position.

An archery bow B may also be temporarily fastened to the hoist line. With the bow handle engaging strap 70 in an open position, as shown in FIG. 7, the handle H of the bow is placed against the webbing material 72 of the bow handle engaging strap 70. The free end of the webbing material 72 is then inserted through the strap lock 74, drawn tight against the bow handle H, doubled back against itself, and held in position by mating hook-and-loop fastener materials 78 and 80. The string S of the archery bow is held against the hoist-line strap 10 by the bow string engaging strap 90. In the preferred embodiment of the invention the bow handle engaging strap 70 and the bow string engaging strap 90 are positioned apart a sufficient distance to allow the string S to fit between the top ends of the mating hook-and-loop fastener materials 78 and 80 and point of attachment 100 of the webbing material 92 to the hoist-line strap 10.

A pack, satchel or other hunting gear may also be attached to the snap hook 30 at the bottom end **10*b* of the hoist-line strap 10**.

After the equipment (i.e. firearm, archery bow and/or pack) is secured to the hoist line 1 in the manner described above, the snap hook 20 at the upper end **10*a* of the hoist-line strap may be attached to a person's belt, pack, harness, or other apparel. Once the hoist line 1 is attached to the person and the equipment to be hoisted (i.e. firearm, archery bow and/or pack), he may then begin climbing to the desired elevated position, leaving the lower end 10*b* of the hoist-line strap (and the equipment to be hoisted) on the ground. In the preferred embodiment of the invention the hoist-line strap 10 is approximately 25 to 30 feet long, and the barrel engaging loop 60 is approximately 36 to 42 inches from the lower end 10*b* of the hoist-line strap 10. Thus, it will be appreciated that a person can climb to an elevated position of some 25 feet, or so, above the ground (i.e. above the equipment to be hoisted) with hoist line 1 attached to him, while the equipment to be hoisted remains on the ground. After the person has obtained his desired elevated position, the equipment to be hoisted may then be easily and safely hoisted by hand from above by pulling up the hoist-line strap 10**.

It will be appreciated from the above disclosure that, when attached to the present invention in the manner described, the firearm will remain substantially parallel to the longitudinal axis of the hoist-line strap 10 while it is being hoisted. Thus, it will be understood that, under most circumstances, the axis of the firearm will be substantially vertically oriented while the hoist line 1 is being pulled up from above. Because the firearm remains substantially vertically oriented while the hoist line 1 is being pulled from above, the opportunity for the firearm to become entangled (i.e. with tree branches or the like) is minimized.

It will also be appreciated that, because the trigger guard snap hook 50 and the bow handle engaging strap 70 are positioned on opposite faces of the hoist-line strap 10, it is possible to attach both a rifle and an archery bow to the hoist line 1, adjacent to each other, at the same time without the two devices becoming entangled with each other.

While the above description contains many specificities, these should not be construed as limitations on the scope of the invention, but rather as an exemplification of one preferred embodiment thereof. Many other variations are possible, for example: The snap hooks (20, 50 and 30) may each be constructed of common mechanical fastening mechanisms, and may be constructed without spring biasing, without swivels, and without finger extensions; and the various strap and webbing materials may be secured to each other by common attachment means, including rivets and heat sealing, rather than by sewing.

Accordingly, the scope of the invention should be determined not by the embodiment illustrated, but by the appended claims and their legal equivalents.

I claim:

1. A hoisting device for supporting an elongate firearm, comprising:

an elongate strap member having a from face and a back face, and a top end and a bottom end;

a first mechanical fastener member attached to said elongate strap member in close proximity to said top end, wherein said first mechanical fastener member is capable of releasable attachment to a person;

barrel holding means attached to said elongate strap member relatively closer to said bottom end than to said top end, for securing a barrel of an elongate firearm to said elongate strap member;

wherein said barrel holding means comprises a closed loop adapted to receive a barrel of an elongate firearm;

trigger guard holding means attached to said elongate strap member, for releasably attaching a trigger guard of an elongate firearm to said elongate strap member, said trigger guard holding means comprising a second mechanical fastener and being attached to said elongate strap member between said bottom end and said barrel holding means.

2. The device according to claim 1, wherein an axis perpendicular to a plane of said closed loop is oriented substantially parallel to a longitudinal axis of a segment of said elongate strap member at a point of attachment of said barrel holding means to said elongate strap member.

3. The device according to claim 2, wherein said trigger guard holding means further comprises a first fabric member attached to said front face of said elongate strap member and attached to said second mechanical fastener.

4. The device according to claim 3, further comprising means for releasably attaching an archery bow and bow string to said elongate strap member.

5. The device according to claim 4 wherein said means for releasably attaching an archery bow and bow string to said elongate strap member comprises:

a bow engaging member comprising a second fabric member attached to said back face of said elongate strap member;

a string engaging member comprising a third fabric member attached to said back face of elongate strap member.

6. The device according to claim 5, wherein said second fabric member has a first end and a second end and a longitudinal axis therebetween, said first end of said second fabric member being attached to said elongate strap member between said bottom end and said barrel holding means, and said longitudinal axis of said second fabric member being substantially parallel to a longitudinal axis of said elongate strap member at a point of attachment of said second fabric member to said elongate strap member;

and wherein said third fabric member has a first end and a second end and a longitudinal axis therebetween, said first end of said third fabric member being attached to said elongate strap member between said bottom end and said first end of said second fabric member, and said longitudinal axis of said third fabric member being substantially parallel to a longitudinal axis of said elongate strap member at a point of attachment of said third fabric member to said elongate strap member.

7. The device according to claim 6 wherein said string engaging member further comprises mating hook and loop fastener members on opposing faces of said elongate strap member and said third fabric member.

8. The device according to claim 3 wherein said elongate strap member has a measurable length from said top end to said bottom end, and wherein a segment of said elongate strap member extending from said bottom end to a point of attachment of said barrel holding means to said elongate strap member is no more than one-fifth of said measurable length from said top end to said bottom end.

9. The device according to claim 1, further comprising an additional mechanical fastener member attached to the bottom end of the elongate strap member.

10. The device according to claim 9, wherein said additional mechanical fastener member is capable of attaching a pack to said elongate strap member.

11. A hoisting device for supporting an archery bow, comprising:

an elongate strap member having a front face and a back face, and a top end and a bottom end;

a first mechanical fastener member attached to said elongate strap member in close proximity to said top end, wherein said first mechanical fastener member is capable of releasable attachment to a person;

a bow engaging member comprising a first fabric member attached to said back face of said elongate strap member;

a string engaging member comprising a second fabric member attached to said back face of said elongate strap member.

12. The device according to claim 11, wherein said first fabric member has a first end and a second end and a longitudinal axis therebetween, said first end of said first fabric member being attached to said elongate strap member in dose proximity to said bottom end, and said longitudinal axis of said first fabric member being substantially parallel to a longitudinal axis of said elongate strap member at a point of attachment of said first fabric member to said elongate strap member;

and wherein said second fabric member has a first end and a second end and a longitudinal axis therebetween, said first end of said second fabric member being attached to said elongate strap member between said bottom end and said first end of said first fabric member, and said longitudinal axis of said second fabric member being substantially parallel to a longitudinal axis of said elongate strap member at a point of attachment of said second fabric member to said elongate strap member.

13. The device according to claim 12 wherein said string engaging member further comprises mating hook and loop fastener members on opposing faces of said elongate strap member and said second fabric member.

14. The device according to claim 11 wherein said elongate strap member has a measurable length from said top end to said bottom end, and wherein a segment of said elongate strap member extending from said bottom end to a point of attachment of said bow engaging means to said elongate strap member is no more than one-fifth of said measurable length from said top end to said bottom end.

15. The device according to claim 11, further comprising an additional mechanical fastener member attached to the bottom end of the elongate strap member.

16. The device according to claim 15, wherein said additional mechanical fastener member is capable of attaching a pack to said elongate strap member.

* * * * *

UNITED STATES PATENT AND TRADEMARK OFFICE
CERTIFICATE OF CORRECTION

PATENT NO : 5,655,803

DATED : August 12, 1997

INVENTOR(S) : Hency Michael Tacoronte

It is certified that error appears in the above-identified patent and that said Letters Patent is hereby corrected as shown below:

On the title page, item [76], in the inventors address: "1840" should be --1848--, and "Chesapeke" should be --Chesapeake--. These In FIG. 2, "B" should be --$B_2$--, and "72" should be --90--.

At column 3, line 36, "it" should be deleted.

At column 4, line 64, "B" should be --$B_2$--.

At column 6, line 4, "from" should be --front--.

ment filed October 29, 1996; and

At column 7, line 30, "dose" should be --close--.

Signed and Sealed this

Sixteenth Day of June, 1998

*Attest:*

*Attesting Officer*

Bruce Lehman

BRUCE LEHMAN

*Commissioner of Patents and Trademarks*